US007742729B2

(12) United States Patent
Sawai

(10) Patent No.: US 7,742,729 B2
(45) Date of Patent: Jun. 22, 2010

(54) TRANSFER DEVICE, IMAGE FORMING APPARATUS AND METHOD FOR EVALUATING ELECTRIC PROPERTY

(75) Inventor: Yuuji Sawai, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 520 days.

(21) Appl. No.: 11/759,008

(22) Filed: Jun. 6, 2007

(65) Prior Publication Data

US 2007/0280749 A1 Dec. 6, 2007

(30) Foreign Application Priority Data

Jun. 6, 2006 (JP) ..... 2006-157510

(51) Int. Cl.
*G03G 15/01* (2006.01)
*G03G 15/14* (2006.01)

(52) U.S. Cl. ..... 399/302; 399/308

(58) Field of Classification Search ..... 399/308, 399/302, 314
See application file for complete search history.

(56) References Cited

U.S. PATENT DOCUMENTS 5,208,211 A 5/1993 Kurotori et al.
5,410,339 A 4/1995 Bisaiji et al.
5,890,030 A 3/1999 Namekata et al.
5,953,556 A * 9/1999 Yamanaka
5,953,572 A 9/1999 Takeuchi et al.
6,134,416 A * 10/2000 Tamiya ..... 399/314
6,405,002 B2 6/2002 Ogiyama et al.
6,516,179 B1 2/2003 Sawai et al.
6,611,672 B2 8/2003 Aoki et al.
6,618,565 B2 9/2003 Tamiya et al.
6,697,595 B2 2/2004 Kawagoe et al.
6,741,821 B2 5/2004 Sugino et al.
6,768,892 B2 7/2004 Sawai
6,785,500 B2 8/2004 Takahashi et al.
6,823,149 B2 11/2004 Yoshikawa et al.
6,829,450 B2 12/2004 Tamiya et al.
6,901,234 B2 5/2005 Ogiyama et al.
7,003,238 B2 2/2006 Yoshida et al.
7,174,124 B2 2/2007 Ishibashi et al.
7,356,296 B2 * 4/2008 Ito ..... 399/302

(Continued)

FOREIGN PATENT DOCUMENTS

EP 0 736 820 A1 10/1996

(Continued)

*Primary Examiner*—Susan S Lee
(74) *Attorney, Agent, or Firm*—Oblon, Spivak, McClelland, Maier & Neustadt, L.L.P.

(57) ABSTRACT

A transfer device including a first combination including an intermediate transfer medium and a transfer member applying a transfer bias, and/or a second combination including an intermediate transfer medium, a second transfer member applying a second transfer bias, and an opposing member configured to transfer the toner image on the intermediate transfer medium to a receiving material at a second transfer nip. When the first combination is subjected to 60-second application of a voltage of 1 kV, followed by discharging, 300 times, the absolute value of logarithmic difference between first and $300^{th}$ combined volume resistances is not greater than 0.8 [log(Ω)]. When the second combination is subjected to 60-second application of a voltage of −1 kV, followed by discharging, 300 times, the absolute value of logarithmic difference between the first and $300^{th}$ combined volume resistances is not greater than 0.5 [log(Ω)].

18 Claims, 7 Drawing Sheets

U.S. PATENT DOCUMENTS

| | | | |
|---|---|---|---|
| 2005/0013636 | A1 | 1/2005 | Sawai et al. |
| 2005/0286930 | A1 | 12/2005 | Sawai et al. |
| 2006/0056884 | A1 | 3/2006 | Sawai et al. |
| 2006/0127116 | A1 | 6/2006 | Ogiyama et al. |

FOREIGN PATENT DOCUMENTS

| | | | |
|---|---|---|---|
| EP | 1 424 608 | A2 | 6/2004 |
| EP | 1 473 603 | A1 | 11/2004 |
| JP | 2001-109277 | | 4/2001 |
| JP | 2003-131498 | | 5/2003 |
| JP | 2004-252134 | | 9/2004 |
| JP | 2005-258287 | | 9/2005 |

* cited by examiner

TRANSFER DEVICE, IMAGE FORMING APPARATUS AND METHOD FOR EVALUATING ELECTRIC PROPERTY

BACKGROUND OF THE INVENTION

1. Field of the Invention

The present invention relates to a transfer device which transfers a material 1 such as toner images. In addition, the present invention also relates to an image forming apparatus including a transfer device, and a method for evaluating an electrical property of a combination of two or more members.

2. Discussion of the Background

Image forming apparatuses in which a toner image formed on an image bearing member such as photoreceptors is primarily transferred to an intermediate transfer medium and the toner image is secondarily transferred to a receiving material are well known. These image forming apparatuses typically include a primary transfer roller which serves as a bias application roller configured to apply a primary bias. Such a primary transfer roller and the image bearing member sandwich the intermediate transfer medium to form a primary nip at which the primary image transfer is performed. Further, one of the stretching rollers which tightly stretch the intermediate transfer medium, and an opposing rollers and which the intermediate transfer medium to form a secondary transfer nip at which the secondary image transfer is performed. In this regard, a secondary bias is applied to one of the stretching roller and the opposing roller so that the toner image is well transferred to the receiving material. The roller to which a secondary bias is applied is hereinafter referred to as a secondary transfer roller.

Ion-conducting materials are used for primary and secondary transfer rollers because the unevenness of resistance of the rollers can be reduced. In addition, ion-conducting materials are also used for intermediate transfer media.

However, transfer rollers and intermediate transfer media including an ion-conducting material have a drawback in that the electric resistance thereof increases after repeated use due to application of a transfer bias thereto (this problem is hereinafter referred to as an electric resistance increasing problem). A transfer roller or an intermediate transfer medium having an increased electric resistance decreases the electric field at the primary or secondary transfer nip, resulting in occurrence of a transfer problem in that the primary or secondary transfer operation can not be well performed. In order to prevent occurrence of such a transfer problem, a transfer bias is applied while controlling the current of the transfer bias (i.e., constant-current controlling). Specifically, when the electric resistance of a transfer roller or an intermediate transfer medium increases, the voltage of the transfer bias applied thereto is increased to prevent decrease of the electric field at the primary or secondary transfer nip, resulting in prevention of occurrence of the transfer problem mentioned above.

However, this technique has a drawback in that when the electric resistance of the transfer roller or intermediate transfer medium seriously increases, the voltage of the transfer bias has to be excessively increased, thereby causing a discharging problem such that discharging (abnormal discharging) occurs or a transfer bias increasing problem such that a transfer bias beyond the capacity of an electric power source has to be applied.

Published unexamined Japanese patent application No. (hereinafter referred to as JP-A) 2003-131498 discloses a technique in that an antioxidant is added to a transfer roller to prevent occurrence of the electric resistance increasing problem. In addition, JP-A 2004-252134 discloses an image forming apparatus using an intermediate transfer belt, which has a surface resistivity property such that when the intermediate transfer belt is subjected to application of a voltage, followed by ground discharging 1000 times while measuring the surface resistivity thereof, the absolute value of the logarithmic difference between the first surface resistivity and $1000^{th}$ surface resistivity is not greater than 0.5 [log(Ω/□)]. It is described therein that by using an intermediate transfer medium having such a property, occurrence of the electric resistance increasing problem can be prevented.

In order to well perform a primary transfer operation and a secondary transfer operation, the voltage of the transfer bias is determined depending on the volume resistivity of a combination of the transfer roller and the intermediate transfer medium (this volume resistivity is hereinafter sometimes referred to as the combined volume resistivity). The combined volume resistivity changes depending on variables such as resistivity of each of the transfer roller and the intermediate transfer medium, thickness of the elastic layer of the transfer roller, and thickness of the intermediate transfer medium. Therefore, even when the resistivity of a transfer roller (or an intermediate transfer medium) is controlled, the combined volume resistivity changes if the resistivity of the intermediate transfer medium (or the transfer roller) used in combination of the transfer roller (or the intermediate transfer medium) changes. Therefore, it is hard to prevent occurrence of the transfer bias increasing problem in that the voltage of the transfer bias has to be excessively increased.

In order to prevent occurrence of the problem, it may be possible to periodically watch the resistivity of each of a transfer roller and an intermediate transfer medium to determine whether the resistivity falls in a predetermined resistivity range. However, the costs of the image forming apparatus using this technique increase.

In addition, when a combination of a transfer roller and an intermediate transfer medium is evaluated to determine whether the combination can be used even when repeatedly used, a test in which the combination is set in an image forming apparatus and a large amount of copies (on the order of hundreds of thousands) are produced by the image forming apparatus is performed. This evaluation method takes a long time and is expensive.

Because of these reasons, a need exists for an image forming apparatus which can stably produce high quality images for a long period of time without causing the transfer problem, the transfer voltage increasing problem, etc.

SUMMARY OF THE INVENTION

An aspect of the present invention, a transfer device is provided, which includes an intermediate transfer medium which rotates while contacting an image bearing; and a transfer member (a first transfer member) configured to transfer a toner image on the image bearing member to the intermediate transfer medium at a first transfer nip while contacting the backside of the intermediate transfer medium and applying a first transfer bias thereto, wherein the combination of the intermediate transfer medium and the transfer member has a property such that when the combination is repeatedly subjected to charging and discharging, in which a voltage of 1 kV with a polarity opposite to the charge of the toner is applied for 60 seconds, followed by 10-second discharging, 300 times while measuring the combined volume resistance of the combination, the absolute value of logarithmic difference between the first combined volume resistance and the $300^{th}$ combined volume resistance is not greater than 0.8 [log(Ω)].

Alternatively, a transfer device is provided, which includes an intermediate transfer medium which rotates while bearing a toner image thereon; a transfer member (a second transfer member) configured to transfer the toner image on the intermediate transfer medium to a receiving material at a second transfer nip while contacting the backside (i.e., the side opposite to that bearing the toner image) of the intermediate transfer medium and applying a negative secondary bias thereto; and an opposing member which contacts the backside of the receiving material to transfer the toner image on the intermediate transfer medium to the receiving material at the transfer nip, wherein the combination of the intermediate transfer medium and the second transfer member has a property such that when the combination is repeatedly subjected to charging and discharging, in which a voltage of −1 kV is applied for 60 seconds, followed by 10-second discharging, 300 times while measuring the combined volume resistance, the absolute value of logarithmic difference between the first combined volume resistance and the $300^{th}$ combined volume resistance is not greater than 0.5 [log(Ω)].

As another aspect of the present invention, an image forming apparatus is provided, which includes an image bearing member configured to bear a toner image thereon, and the first-mentioned transferring device and/or the second-mentioned transferring device.

As yet another aspect of the present invention, a method of producing a transfer device of good quality is provided. The transfer device includes an intermediate transfer medium and at least one transfer member for applying a transfer bias to the intermediate transfer medium, and the method includes:

a) providing a candidate combination of a candidate for the intermediate transfer medium and a candidate for the transfer member;

b) repeatedly subjecting the candidate combination to a voltage ON-OFF operation, in which a voltage equal to the transfer bias is applied to the combination, predetermined times while measuring a combined volume resistance of the combination;

c) calculating change of the combined volume resistance of the candidate combination to determine whether the change falls in a predetermined range;

if the change falls in the predetermined range, the candidate combination is determined to be an acceptable combination;

if the change does not fall in the predetermined range, providing at least one further candidate combination, and repeating the steps b) and c) for the at least one further candidate combination until an acceptable combination has been determined; and assembling the transfer device using the acceptable combination.

As a further aspect of the present invention, a method for evaluating the electric property of a combination of an intermediate transfer medium bearing a material (such as toner images) thereon and a transfer member configured to transfer a material onto the intermediate transfer medium or transfer a material on the intermediate transfer medium to another material while contacting the backside of the intermediate transfer medium and applying a transfer bias, is provided. The method includes:

sandwiching the intermediate transfer medium by the transfer member and a metal electrode;

repeatedly subjecting the combination to an ON-OFF operation of a voltage, which is equal to that of an initial voltage of the transfer bias applied to the transfer member and which is applied between the transfer member and the metal electrode, predetermined times while measuring the combined volume resistance of the combination; and calculating the change of the combined volume resistance of the combination to determine whether the change falls in the predetermined range.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
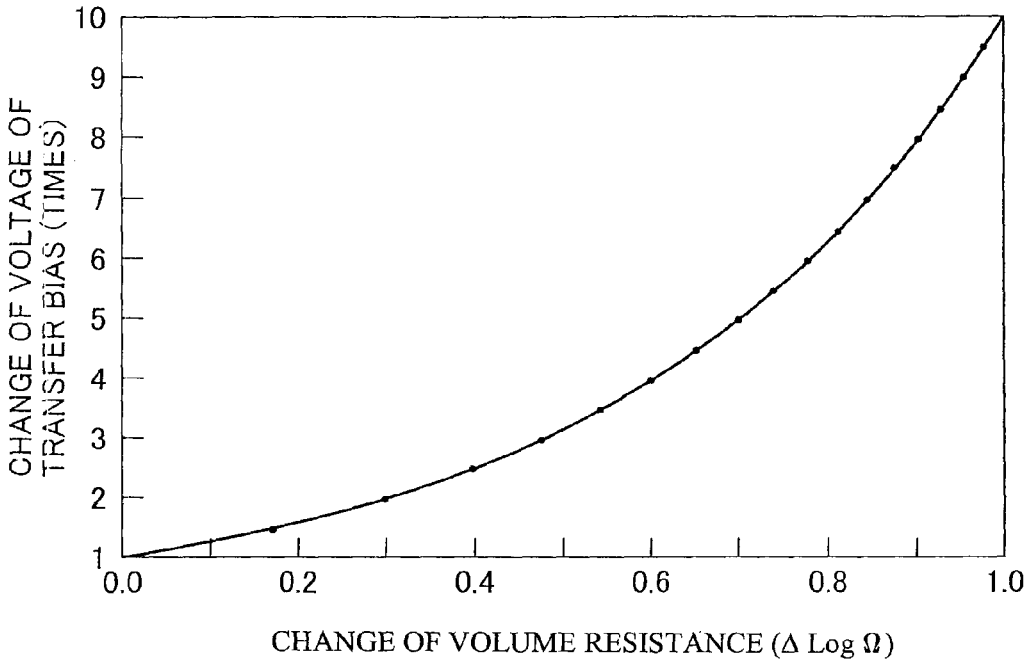
FIG. 1 is a graph illustrating the relationship between change of the combined volume resistance of a combination of a transfer member and an intermediate transfer medium and change of the voltage of the transfer bias to be applied to the combination.

The transfer device of the present invention includes an intermediate transfer medium which rotates while contacting an image bearing member; and a first transfer member (a primary transfer member) configured to transfer a toner image on the image bearing member to the intermediate transfer medium at a first transfer nip while contacting the backside of the intermediate transfer medium and applying a transfer bias thereto. In this transfer device, the combination of the intermediate transfer medium and the transfer member has a property such that when the combination is repeatedly subjected to 60-second application of a voltage of 1 kV with a polarity opposite to the charge of the toner, followed by 10-second discharging 300 times while measuring the combined volume resistance of the combination, the absolute value of logarithmic difference between the first combined volume resistance and the $300^{th}$ combined volume resistance is not greater than 0.8 [log(Ω)].

The present inventors performed an experiment. Specifically, a voltage of 1 kV with a polarity opposite to that of the charge of a toner is applied for 60 seconds to a combination of an intermediate transfer medium and a transfer member configured to transfer an image of the toner to the intermediate transfer medium, and the combination is then discharged for 10 seconds. The voltage application operation and the discharging operation are repeated 300 times while measuring the combined volume resistance of the combination. In addition, the present inventors performed a running test in which 300,000 copies are produced using an image forming apparatus including the intermediate transfer medium and transfer member while periodically measuring the combined volume resistance of the combination. As a result of the experiment, it is found that the change of the combined volume resistance in the experiment is similar to the change of the combined volume resistance thereof at a time in the running test, in which 200,000 to 300,000 copies are produced. Namely, it is found that the change of the combined volume resistance of a combination of an intermediate transfer medium and a transfer member in an image forming apparatus can be estimated from the change of the combined volume resistance of the combination in the voltage application and discharging test mentioned above.

It is well known that when the transfer bias becomes greater than about 7 kV, abnormal discharging tends to occur. Therefore it is preferable that the combined volume resistance of a combination of an intermediate transfer medium and a transfer member is controlled such that the image transfer operation can be well performed at a transfer bias of not greater than 7 kV even after repeated production of images. In general, since the initial transfer bias is 1 kV, the change of the transfer bias is preferably controlled so as to be within 7 times (i.e., 7 kV/1 kV).

FIG. 1 is a graph illustrating the relationship between change of the combined volume resistance of a combination of a transfer member and an intermediate transfer medium and change of the voltage of the transfer bias to be applied to the combination. It is clear from FIG. 1 that when the change of the combined volume resistance (i.e., $|\log Rv001\ (\Omega)-\log Rv300\ (\Omega)|$) is 0.8 [log Ω], the change of voltage of the transfer bias is 6.31 times. In this case, the voltage of the transfer bias has to be increased from 1 kV to 6.31 kV to well perform the transfer operation. Since the voltage of the transfer bias is less than the discharge voltage (i.e., 7 kV) by about 700V, the transfer bias has a sufficient tolerance. Therefore, by controlling the change of the combined volume resistance within 0.8 [log (Ω)], the transfer operation can be well performed without causing the abnormal discharging problem.

Thus, by using a proper combination of an intermediate transfer medium and a primary transfer member having a combined volume resistance property such that when the combination is repeatedly subjected to 60-second application of a voltage of 1 kV with a polarity opposite to the charge of the toner followed by 10-second discharging 300 times, the absolute value of logarithmic difference ($|\log Rv001(\Omega)-\log Rv300\ (\Omega)|$) between the first combined volume resistance ($Rv001(\Omega)$) and the $300^{th}$ combined volume resistance ($Rv300(\Omega)$) is not greater than 0.8 [$\log(\Omega)$], the transfer operation can be well performed by the combination without causing the abnormal discharging problem. By using this technique, it is unnecessary to check the property (such as electric resistance) of each of the intermediate transfer medium and transfer member to determine whether the property falls within the predetermined range. Therefore, the costs of the transfer device (and the image forming apparatus) can be reduced.

In a case of a secondary transfer device including an intermediate transfer medium and a secondary transfer roller, the similar evaluation method can be used except that a voltage of 1 kV with the same polarity as that of the toner is applied. The absolute value of logarithmic difference ($|\log Rv001(\Omega)-\log Rv300(\Omega)|$) is preferably not greater than 0.5 [$\log(\Omega)$]. The reason why the difference is smaller than that in the case of the primary transfer device is as follows. Since the secondary transfer operation is performed while a receiving material is sandwiched by the intermediate transfer medium and secondary transfer member and the resistance of the receiving material considerably changes, the transfer bias has to be changed depending on the resistance of the receiving material. Therefore, it is preferable that in the secondary transfer operation the transfer bias has a more sufficient tolerance than in the primary transfer operation. In addition, the voltage of the initial secondary transfer bias is typically 1.5 kV. It can be understood from FIG. 1 that when the change of the combined volume resistance is 0.5 [logΩ], the change of voltage of the transfer bias is 3.16 times. Therefore, the voltage of the transfer bias has to be increased from 1.5 kV to 4.7 kV, which is less than the discharging voltage (i.e., 7 kV) by 2.3 kV. In this case, the voltage of the transfer bias never exceeds 7 kV and thereby occurrence of the abnormal discharging problem can be prevented even when the resistance of the receiving material largely changes.

In addition, the present inventors discover that when a secondary transfer bias with a negative polarity is applied, the change of the combined volume resistance of the combination after repeated use can be controlled to be relatively smaller than that in the case where a secondary transfer bias with a positive polarity is applied. Thus, by applying a negative secondary transfer bias, increase of the secondary transfer bias can be prevented.

The present application also provides a method for evaluating an electric property of a combination of an intermediate transfer medium bearing a material (such as toner images) and a transfer member configured to transfer the material on the intermediate transfer medium to another material while contacting the backside of the intermediate transfer medium and applying a transfer bias. The method includes sandwiching the intermediate transfer medium by the transfer member and a metal electrode; repeatedly subjecting the combination to an ON-OFF operation of a voltage, which is equal to an initial voltage of the transfer bias applied to the transfer member, predetermined times while measuring the combined volume resistance of the combination; and calculating the change of the combined volume resistance of the combination to determine whether the change falls in the predetermined range. By using this method, a combination of an intermediate transfer medium and a transfer member can be evaluated more rapidly than in conventional evaluating methods.

Hereinafter, a tandem full color image forming apparatus using an intermediate transfer medium, which is an example of the image forming apparatus of the present invention, will be explained by reference to drawings.

Figure 2:
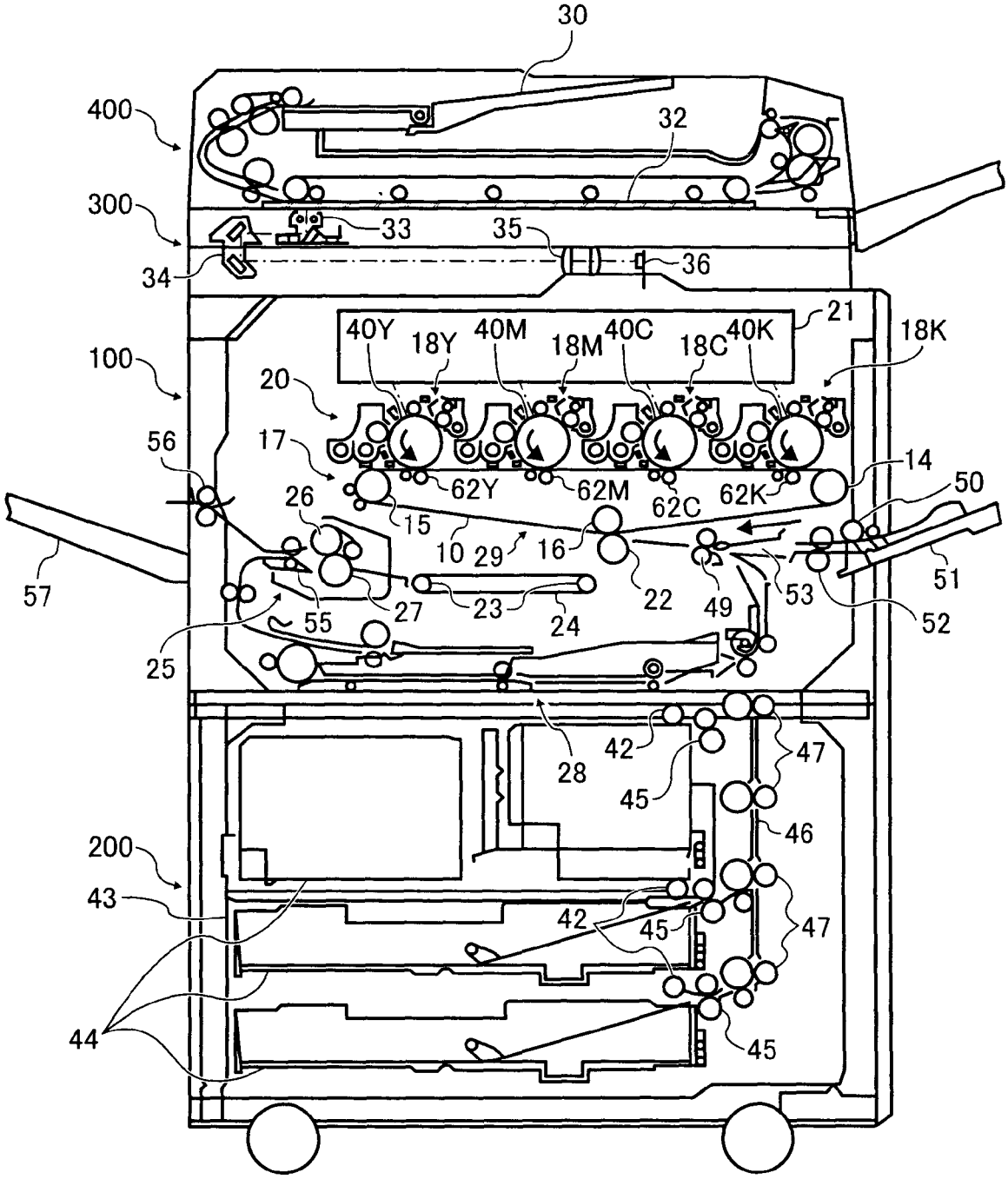
FIG. 2 is a schematic view illustrating an example of the image forming apparatus of the present invention.

FIG. 2 is a schematic view illustrating an example of the image forming apparatus of the present invention.

At first, the basic configuration of the image forming apparatus will be explained. FIG. 2 is a schematic view illustrating the image forming apparatus. The image forming apparatus includes a printer section 100, a receiving material feeding section 200, a scanner 300 located above the printer section 100, an automatic document feeder (ADF) 400 provided on the scanner 300, and a controller (not shown) configured to control the operations of the image forming apparatus.

The scanner 300 reads the image information of an original set on a glass plate 32 using a sensor 36, and sends the read information to the controller. The controller controls a light source (such as laser diodes and light emitting diodes) provided in a light irradiating device 21 of the printer section 100 such that the light source irradiates photoreceptors 40Y, 40M, 40C and 40K with a light beam including the image information. As a result, electrostatic latent images are formed on the respective photoreceptors. The thus formed electrostatic latent images are developed with respective color developers (i.e., developers including yellow, magenta, cyan and black color toners), resulting in formation of yellow, magenta, cyan and black color toner images on the respective photoreceptors. The photoreceptors 40Y, 40M, 40C and 40K are arranged in a tandem image forming section 20 of the printer section 100. In this regard, the suffixes Y, M, C and K represents yellow, magenta, cyan and black colors, respectively.

The receiving material feeding section 200 includes plural cassettes 44 arranged one by one in a vertical direction in a receiving material bank 43, a feeding passage 46, and plural pairs of feeding rollers 47 provided on several portions of the feeding passage 46. Each of the cassettes 44 includes a feeding roller 42 configured to feed an uppermost sheet of the receiving material sheets contained therein. In addition, each cassette includes a separating roller 45 configured to separate plural sheets, which are mistakenly fed at the same time by the feeding roller 42, and feed the separated sheets to the feeding passage 46. The pairs of feeding rollers 47 feed the sheet of the receiving material, which has been fed by the cassette 44, toward the uppermost pair of feeding rollers 47.

The image forming apparatus also includes a manual feeding device as well as the feeding section 200. The manual feeding device includes a tray 51 which is located on a side portion of the printer section 100. The manual feeding device also includes a feeding roller 50 and a separating roller 52 to feed a sheet of the receiving material toward the printer section 100 along a guide 53.

The receiving material sheet fed from the feeding section 200 or the manual feeding device is pinched by a pair of registration rollers 49. The pair of registration rollers timely feed the sheet to a secondary nip formed by an intermediate transfer medium 10 and a secondary transfer roller 22.

When a color copy is produced by the image forming apparatus, at first an original is set on a table 30 of the ADF 400 or on the glass plate 32 of the scanner 300, which can be exposed by opening the ADF 400. When a start switch (not shown) is pressed, driving of the scanner 300 is started to read the image information of the original fed from the ADF or set on the glass plate. Specifically, a first traveler 33 starts to run and irradiates the surface of the original so that the light reflected from the original is fed toward a second traveler 34, which also starts to run. The light reflected from a mirror of the second traveler 34 is fed to the sensor 36 through a focus lens 35. Thus, the image information of the original is read by the scanner 300.

When the controller receives the image information from the scanner 300, the controller controls the above-mentioned image writing operation and developing operation to form yellow, magenta, cyan and black toner images on the respective photoreceptors 40Y, 40M, 40C and 40K.

Figure 3:
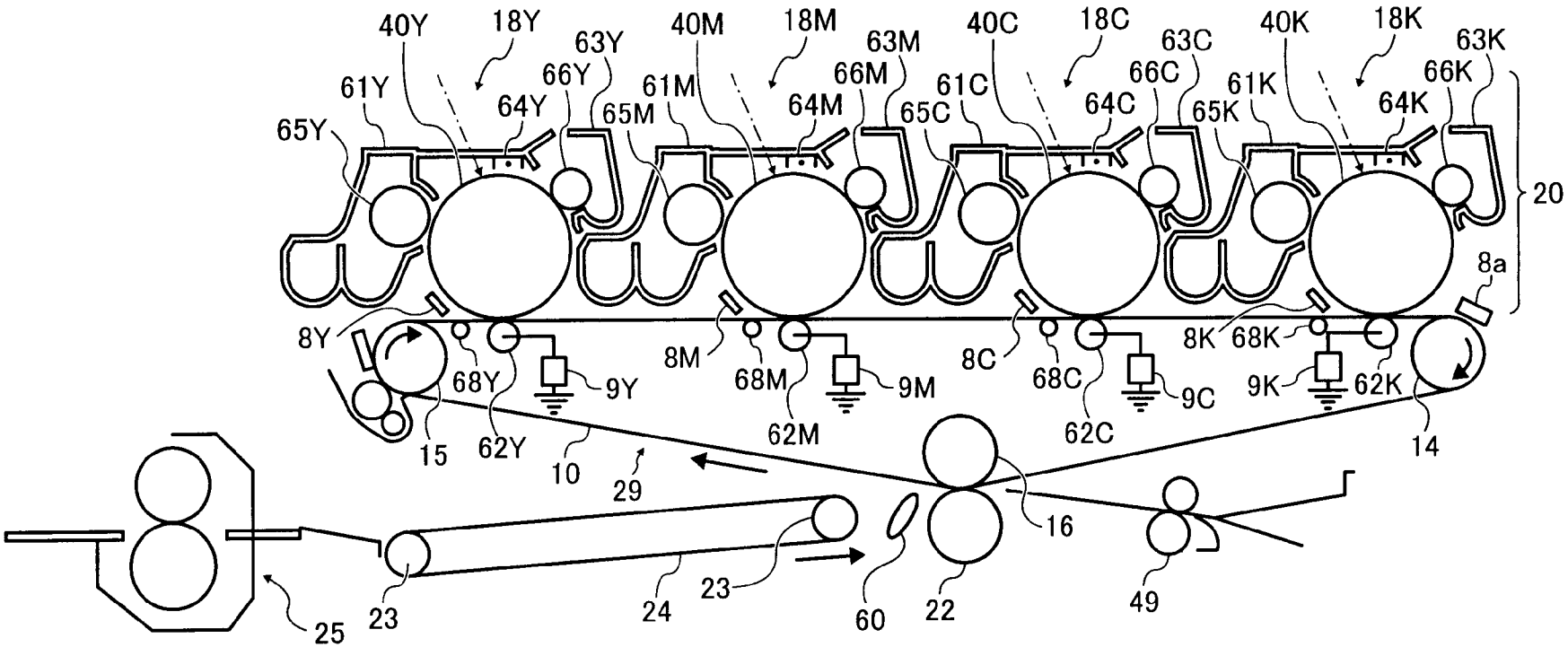
FIG. 3 is an enlarged view of the printer section of the image forming apparatus illustrated in FIG. 1.

FIG. 3 is an enlarged view of the printer section 100. Referring to FIG. 3, the tandem image forming section 20 includes four process units 18Y, 18M, 18C and 18K. The four process units use different color toners but have the same configuration. Therefore, only the process unit 18Y will be explained.

The process unit 18Y includes the photoreceptor 40Y, a charger 64Y, a developing device 61Y, and a cleaner 63Y configured to clean the surface of the photoreceptor. The photoreceptor 40Y serving as a latent image bearing member is rotated counterclockwise by a driving device (not shown), and the surface of the photoreceptor is uniformly charged by the charger 64Y. Thus, the photoreceptor 40Y has a non-image potential V. The light irradiating device 21 (illustrated in FIG. 2) irradiates the charged photoreceptor 40Y with imagewise light. The lighted portion of the photoreceptor has an image potential $V_L$, which is lower than the non-image potential V. Thus, an electrostatic latent image is formed. The thus formed electrostatic latent image is developed by a developing roller 65Y of the developing device 61Y using a yellow toner, resulting in formation of a yellow toner image on the photoreceptor 40Y. The yellow toner image is then transferred onto the surface of the intermediate transfer belt 10 (i.e., primary image transfer). After the toner image is transferred, the surface of the photoreceptor 40Y is cleaned by a cleaning brush 66Y of the cleaner 63Y (i.e., toner particles remaining on the surface of the photoreceptor are removed). Similar image forming operations are performed in each of the other process units, and thereby magenta, cyan and black toner images are formed on the respective photoreceptors 40M, 40C and 40K.

A transfer device 29 is arranged below the image forming section 20. In the transfer device 29, the intermediate transfer belt 10 serving as an intermediate transfer medium is rotated clockwise while tightly stretched. The transfer device 29 also includes a belt cleaner 17, four primary transfer rollers 62Y, 62M, 62C and 62K, and a secondary transfer section.

The intermediate transfer belt 10 is rotated clockwise by stretching rollers 14, 15 and 16 while tightly stretched by the stretching rollers, one of which is rotated by a driving device (not shown). The primary transfer rollers 62Y, 62M, 62C and 62K press the intermediate transfer belt 10 toward the photoreceptors 40Y, 40M, 40C and 40K, resulting in formation of primary transfer nips at which the intermediate transfer belt 10 is contacted with the photoreceptors and each of which has a predetermined nip width in the moving direction of the intermediate transfer belt. Power sources 9Y, 9M, 9C and 9K apply primary transfer biases to the primary transfer rollers 62Y, 62M, 62C and 62K, respectively, and thereby primary transfer electric fields are formed at the primary transfer nips. The yellow, magenta, cyan and black toner images formed on the respective photoreceptors are transferred onto the intermediate transfer belt 10 by application of primary transfer electric fields and pressures at the primary transfer nips. In this regard, the toner images are transferred in the order of yellow, magenta, cyan and black toner images. Thus, the four color toner images are overlaid on the surface of the intermediate transfer belt 10.

The secondary transfer section is constituted of the stretching roller 17 and an opposing roller 22, which sandwich the intermediate transfer belt 10. A negative transfer bias is applied to the secondary transfer section to form a secondary transfer electric field. Specifically, when a negatively charged toner is used, a negative bias is applied to the stretching roller 16. In this case, the stretching roller 16 serves as a secondary transfer member.

As mentioned above by reference to FIG. 1, the receiving material sheet fed to the printer section 100 is pinched by the pair of registration rollers 49, and is timely fed to the secondary transfer nip so that the four color toner images on the intermediate transfer belt are transferred to a proper position of the receiving material sheet (i.e., secondary transfer). Thus, a full color toner image is formed on the receiving material sheet. The receiving material sheet bearing the full color toner image thereon is fed to a fixing device 25 by a feeding belt 24 which is a rotating endless belt supported by rollers 23. In the fixing device 25, the receiving material sheet is sandwiched by a heating member 26 and a pressure roller 27 and thereby the full color toner image is fixed on the sheet. The receiving material sheet bearing a fixed toner image thereon is discharged to a tray 57 by a pair of rollers 56 while the bath is properly selected by a paper path changing pick 55.

When a double-sided copy is produced, the receiving material sheet having a toner image on one side thereof is fed to the sheet-reversing device 28 to be reversed. The receiving material sheet is then fed to the second transfer device 24 so that an image is transferred to the other side of the receiving material sheet. The image is fixed by the fixing device 25 and then the double-sided copy is discharged to the tray 57 by the pair of rollers 56.

In FIG. 3, numerals 8Y, 8M, 8C and 8k denote sensors configured to detect the image densities of the toner images on the photoreceptors 40Y, 40M, 40C and 40K, respectively, and numeral 8*a* denotes a sensor configured to detect the deviation in position of the toner image on the intermediate transfer medium 10. Numerals 68Y, 68M, 68C and 68K denote rollers configured to form primary transfer nips.

The pair of registration rollers 49 are typically grounded, but a bias can be applied to remove dusts (such as paper dusts caused by the receiving material) thereon.

Next, the transfer device 29, which is one example of the transfer device of the present invention, will be explained in detail.

The transfer device 29 includes the intermediate transfer belt 10, belt cleaner 17, four primary transfer rollers 62Y, 62M, 62C and 62K, and opposing roller 22. The primary transfer bias applied to each of the four primary transfer rollers is initially 1 kV. The secondary transfer bias applied to a secondary transfer roller (such as the opposing roller 22 and stretching roller 16) is initially −1.5 kV.

The primary transfer bias is controlled to have a constant current or a constant voltage. By performing constant-current controlling on the primary transfer bias, occurrence of the transfer problem can be prevented even when the combined volume resistance of the combination of the primary transfer roller 62 and the intermediate transfer belt 10 increases. When performing constant-voltage controlling, occurrence of a problem in that transferability of toner images changes depending on the image area proportion of the toner images due to change of the current flowing the toner images can be prevented. However, when the combined volume resistance of the combination of the primary transfer roller 62 and the intermediate transfer belt 10 increases, the primary transfer current decreases, thereby deteriorating the transferability of the combination. Therefore, when constant voltage controlling is performed, it is preferable to check the primary transfer current and primary transfer voltage at predetermined times (for example, after feed of a predetermined number of receiving material sheets, or after a predetermined total time of primary transfer bias application) and change the voltage of the transfer bias so that the transfer current becomes the same as the initial transfer current. By using this method, occurrence of the transfer problem can be prevented even when the combined volume resistance of the combination of the primary transfer roller 62 and the intermediate transfer belt 10 increases.

In addition, it is preferable that the voltage of the primary transfer bias is adjusted depending on changes of usage of the combination, and variations of the physical properties of the primary rollers and intermediate transfer belt. The primary transfer voltage controlling method is not limited thereto, and any known controlling methods can be used.

The intermediate transfer belt 10 may have a single-layered structure or a multi-layered structure. In addition, the method for preparing the intermediate transfer belt is not particularly limited, and any known methods such as dipping methods, centrifugal molding methods, extrusion molding methods, inflation methods, and coating methods can be used.

Suitable materials for use in preparing the intermediate transfer belt 10 include polyimide resins, polyamide imide resins, polycarbonate resins, polyphenylene sulfide resins, polyurethane resins, polybutylene terephthalate resins, polyvinylidene fluoride resins, polysulfone resins, polyether sulfone resins, polymethyl pentene resins, and combinations thereof. In view of the strength, polyimide resins, and polyamide imide resins are preferably used. It is preferable to add an electro conductive carbon black to the intermediate transfer belt to control the resistivity thereof.

Next, an example of the centrifugal molding method for preparing the intermediate transfer belt 10 using a polyimide resin will be explained.

Polyimide resins are typically prepared by subjecting an aromatic polycarboxylic anhydride (or a derivative thereof) and an aromatic diamine to a condensation reaction. Because of having a rigid main chain, such polyimide resins are insoluble in solvents and are not melted even when heated. Therefore, at first, a polyamic acid (i.e., a polyamide acid or an aromatic polyimide precursor), which can be dissolved in an organic solvent, is prepared by reacting an anhydride with an aromatic diamine. After the polyamic acid (or the like) is molded by any known methods, the molded polyamic acid is heated or subjected to a chemical treatment to perform dehydration and ring formation (i.e., imidization). Thus, a molded polyimide resin is prepared.

Specific examples of the aromatic polycarboxylic anhydrides include ethylenetetracarboxylic dianhydride, cyclopentanetetracarboxylic dianhydride, pyromellitic anhydride, 3,3',4,4'-benzophenonetetracarboxylic dianhydride, 3,3',4,4'-biphenyltetracarboxylic dianhydride, etc., but are not limited thereto. These compounds can be used alone or in combination.

Specific examples of the aromatic diamines include m-phenylenediamine, o-phenylenediamine, p-phenylenediamine, m-aminobenzylamine, p-aminobenzylamine, 4,4'-diamino diphenyl ether, 3,3'-diaminodiphenyl ether, 3,4'-diamino diphenyl ether, etc., but are not limited thereto These compounds can be used alone or in combination.

By polymerizing an aromatic polycarboxylic anhydride with a diamine, which are mixed in a molar ratio of about 1:1, in a polar organic solvent, a polyimide precursor (i.e., a polyamic acid) can be prepared. Suitable solvents for use as the polar organic solvent includes any known polar organic solvents, which can dissolved a polyamic acid, and N,N-dimethylformamide and N-methyl-2-pyrrolidone are preferably used.

Although it is easy to synthesize a polyamic acid, various polyimide varnishes in which a polyamic acid is dissolved in an organic solvent are marketed. Specific examples of such varnishes include TORAYNEECE (from Toray Industries Inc.), U-VARNISH (from Ube industries, Ltd.), RIKACOAT (from New Japan Chemical Co., Ltd.), OPTOMER (from Japan Synthetic Rubber Co., Ltd.), SE812 (from Nissan Chemical Industries, Ltd.), CRC8000 (from Sumitomo Bakelite Co., Ltd.), etc.

Specific examples of the resistivity controlling agents for use in the polyimide resins include powders of electroconductive resistivity controlling agents such as carbon black, graphite, metals (e.g., copper, tin, aluminum, and indium), metal oxides (e.g., tinoxide, zincoxide, titaniumoxide, indium oxide, antimony oxide, bismuth oxide, tin oxide doped with antimony, and indium oxide doped with tin), etc. In addition, ion-conducting resistivity controlling agents can also be used. Specific examples thereof include tetraalkylammonium salts, trialkylbenzyl ammonium salts, alkylsulfonic acid salts, alkylbenzenesulfonic acid salts, alkylsulfates, esters of glycerin and a fatty acid, esters of sorbitan and a fatty acid, polyoxyethylenealkylamine, esters of polyoxyethylene-aliphatic alcohols, alkylbetaine, lithium perchlorate, etc., but are not limited thereto.

Among these resistivity controlling agents, carbon black is preferably used for polyimide resins.

The thus prepared polyamic acid is heated at a temperature of from 200 to 350° C. to be converted to a polyimide resin.

The change of resistivity of a combination of a resin and a resistivity controlling agent after repeated application of a voltage thereto depends on the dispersion state of the resistivity controlling agent in the resin. Specifically, by improving the dispersion state, pace of increase of the resistivity can be slowed down.

Next, the melt molding method for preparing the intermediate transfer belt 10 will be explained.

Melt molding methods are broadly classified into continuous melt extrusion molding methods, injection molding methods, blow molding methods, inflation molding methods, etc. Among these methods, continuous melt extrusion molding methods are preferably used for preparing a seamless belt.

When continuous melt extrusion molding methods are used for preparing seamless belts, thermoplastic resins are preferably used. Specific examples of such thermoplastic resins include polyethylene, polypropylene, polystyrene, polybutylene terephthalate (PBT), polyethylene terephthalate (PET), polycarbonate (PC), ethylene-tetrafluoroethylene copolymers (ETFE), polyvinylidene fluoride (PVdF), etc.

Carbon black is typically used as an electroconductive agent for the intermediate transfer belt 10. The dispersion state of a carbon black in a belt formed by a melt extrusion method is typically inferior to that in a belt formed by a centrifugal method using a dispersion in which a carbon black is dispersed in a resin solution. Therefore, the variation of resistivity of a belt formed by a melt extrusion method is typically larger than that of a belt formed by a centrifugal method.

Next, the primary transfer rollers 62 and the secondary transfer roller 16 will be explained. These rollers typically have a structure such that an elastic layer made of, for example, a foamed material including an ion-conducting agent is formed on a metal shaft. The specific examples of the materials used for the elastic layer include rubbers having an ion-conducting property, such as epichlorohydrin rubbers, urethane rubbers, nitrile—butadiene rubbers, acrylic rubbers, chloroprene rubbers, fluorine-containing rubbers, nitrile rubbers, norbornene rubbers, etc., and other rubbers such as natural rubbers (NR), butadiene rubbers, isoprene rubbers, styrene-butadiene rubbers (SBR), ethylene-propylene-diene rubbers (EPDM), butyl rubbers, silicone rubbers, etc. These materials can be used alone or in combination. Among these materials, epichlorohydrin rubbers are preferably used because of having a good combination of ionic conductivity and physical properties.

One or more additives such as vulcanizing agents, vulcanization acceleration agents, and ion-conducting agents can be added to the elastic materials. Specific examples of the vulcanizing agents include sulfur, and sulfur-containing organic materials such as tetraalkylthiram disulfide, morphorine disulfide, and alkylphenol disulfide. Among these materials, sulfur is preferably used because of having low costs and good vulcanization properties.

Specific examples of the vulcanization acceleration agents include thiazole compounds such as dibenzothiazolyl disulfide and 2-mercaptobenzothiazole (D); sulfenamide compounds such as cyclohexylsulfenamide; etc.

Specific examples of the ion-conducting agents include cationic surfactants such as quaternary ammonium salts (such as salts of perchloric acid, chloric acid and fluoroboric acid), e.g., lauryltrimethylammonium salts, stearyltrimethylammonium salts, octadecyltrimethylammonium salts, dodecyltrimethylammonium salts, hexadecyltrimethylammonium salts, modified fatty acids-dimethylethylammonium salts; ampholytic surfactants such as aliphatic sulfonic acid salts, salts of sulfuric acid esters of higher alcohols, and salts of sulfuric acid esters of ethylene oxide adducts of higher alcohols; etc. When acrylonitrile-butadiene rubbers (NBR) are used, quaternary ammonium salt type ion-conducting agents are preferably used.

Next, one example of the method for preparing the rollers (the primary transfer rollers 62 and secondary transfer roller 16) will be explained.

At first, an epichlorohydrin rubber and an acrylonitrile-butadiene rubber (NBR) are kneaded with a kneader upon application of heat and shearing force thereto. An electroconductive agent (lauryltrimethylammonium salt), a vulcanization accelerator (dibenzothiazolyldisulfide) and a vulcanization agent (sulfur) are added thereto. Thus, a rubber composition is prepared. The rubber composition is subjected to extrusion molding so as to have a cylindrical form, followed by steam-vulcanization for 50 minutes under conditions of $3.92\times10^5$ Pa (4 kgf/cm$^2$) in pressure, and 140° C. in temperature. After a metal shaft is inserted into the thus prepared rubber cylinder, the surface of the rubber is polished. Thus, a primary (or secondary) transfer roller is prepared. In this regard, the epichlorohydrin rubber is a copolymer of ethylene oxide, arylglycidyl ether and epichlorohydrin, and the acrylonitrile-butadiene rubber is a low-nitrile NBR including acrylonitrile in a small amount.

Each of the primary transfer rollers 62 and the intermediate transfer belt 10 includes a medium-resistance elastic material including an ion-conducting agent. Specifically, the primary transfer rollers include a medium-resistance foamed material containing an ion-conducting agent, and the intermediate transfer belt includes a medium-resistance thin belt containing an ion-conducting agent. When charges are injected to such a medium-resistance foamed material including an ion-conducting agent, the resistivity changes depending on the amount of the injected charges. Since charges are injected to the primary transfer rollers 62 and the intermediate transfer belt at the primary transfer nip, the resistivity thereof changes after repeated use. As a result, the combined volume resistance of the combination of the intermediate transfer belt and one of the primary transfer rollers changes (increases). When constant voltage controlling is performed on the primary transfer bias, the transfer current decreases, thereby causing the transfer problem. Therefore, the voltage of the primary transfer bias is increased at a predetermined time to prevent occurrence of the transfer problem. However, when the combined volume resistance excessively increases, a problem in that the voltage of the primary transfer bias exceeds the upper limit of the power source of the transfer bias and/or a discharging problem in that discharging or leaking occurs between the transfer roller and other members are caused.

Even when constant current controlling is performed on the primary transfer bias, a problem in that the voltage of the primary transfer bias exceeds the upper limit of the power source of the transfer bias and/or the discharging problem are caused if the combined volume resistance excessively increases.

In the present invention, a combination of an intermediate transfer belt and a primary transfer roller is used for the transfer device after evaluating the electric property of the combination using the following method. Specifically, a combination qualifying the following evaluation test can be used for the transfer device and the image forming apparatus of the present invention.

Figure 4:
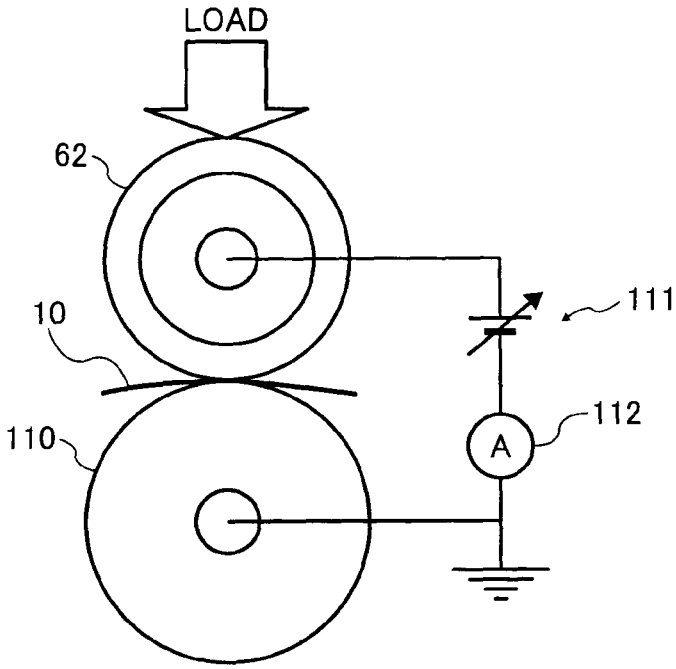
FIG. 4 is a schematic view illustrating an instrument used for measuring the combined volume resistance.

FIG. 4 is a schematic view illustrating an instrument used for measuring the combined volume resistance. The evaluation of a combination of an intermediate transfer belt and a primary transfer roller is performed using this instrument. The instrument includes an opposing metal roller 110, a high voltage power source 111, and an ammeter 112. The opposing roller 110 is a stainless roller having a diameter of 30 mm, which is fixed by a bearing. A sample of the intermediate transfer belt 10 is sandwiched by a sample of the primary transfer roller 62 and the opposing roller 110 while a force of 0.49 N/cm (50 gf/cm) is applied to the primary transfer roller 62. A voltage of +1000V is applied for 60 seconds between the primary transfer roller 62 and the opposing roller 110 to measure the current flowing the primary transfer roller 62 and the opposing roller 110 through the intermediate transfer belt using the ammeter (6514 from Keithley Instruments inc.), followed by discharging for 10 seconds. When the combined volume resistance of the combination is calculated, the current at a time 10 seconds after the start of charging (i.e., application of voltage) is used. Thus, the combined volume resistance is calculated. This volume resistance measuring operation is performed 300 times to determine the difference (i.e., $|\log Rv001(\Omega)-\log Rv300(\Omega)|$) between the first combined volume resistance ($\log Rv001(\Omega)$) and the $300^{th}$ combined volume resistance ($Rv300(\Omega)$). A combination of an intermediate transfer belt and a primary transfer roller having a combined volume resistance in a predetermined range (i.e., 0.8 [log Ω]) can be used for the transfer device (and image forming apparatus) of the present invention.

The measurement is performed under an environmental condition of 22° C. and 55% RH. When the environmental condition is different from the condition, the combined volume resistance is corrected using the following equation, which is a function of the absolute humidity.

$$R=C\times Rm\times(AHr-AHm)$$

wherein R represents the corrected resistivity, C represents a constant which is determined depending on the combination, Rm represents the measured value of the resistivity, AHr represents the absolute humidity in the normal condition (i.e., 22° C. and 55% RH), and AHm represents the absolute humidity in the condition under which the measurement is performed.

Since the primary transfer roller is an ion-conducting roller, the resistivity thereof largely change depending on the environmental condition (temperature and humidity). Therefore, it is preferable that the combination is allowed to settle in the environment for 5 or more hours in which the measurement is to be performed. In addition, the width of the intermediate transfer belt 10 is preferably longer by 5 mm or more than that of the primary transfer roller 62 to prevent flow of current from the edges of the primary transfer roller 62 to the metal roller 110. The change of combined volume resistance (i.e., $|\log Rv001(\Omega\cdot cm)-\log Rv300(\Omega)|$) of a combination in this test corresponds to the change of combined volume resistance of the combination, which is used for producing 200,000 to 300,000 images in an image forming apparatus.

By using this evaluation method, evaluation of a combination of an intermediate transfer belt and a primary transfer roller can be performed more easily and rapidly than an evaluation method in which a running test of producing 200,000 to 300,000 images is performed using an image forming apparatus.

As mentioned above, the combined volume resistance of a combination changes depending on the amount of charges injected thereto. Since the intermediate transfer belt and the primary transfer roller are rotated in an image forming apparatus, the time for which a charge is injected to a portion of the intermediate transfer belt or a portion of the primary transfer roller is very short (i.e., the time for which the portion is present in the transfer nip). Thus, a small amount of charges are injected to the portion in the image forming apparatus. In contrast, in the evaluation instrument illustrated in FIG. 4, charges are injected to one portion of the intermediate transfer belt and one portion of the primary transfer roller, which are not moved. Namely, the amount of charges injected to the portions of the intermediate transfer belt and the primary transfer roller is large. As a result of the present inventors' experiment, it is found that the amount of charges injected to a portion of the intermediate transfer belt (or the primary transfer roller) after production of 200,000 to 300,000 images in an image forming apparatus is almost equal to that injected to one portion of the intermediate transfer belt (or the primary transfer roller) in the evaluation test after the charging operation is performed 300 times. Therefore, by using this evaluation method, evaluation of a combination of an intermediate transfer belt and a primary transfer roller can be performed more easily and rapidly than an evaluation method in which a running test of producing 200,000 to 300,000 images is performed using an image forming apparatus.

In this example of the transfer device of the present invention, a combination of an intermediate transfer belt and a primary transfer roller having a property such that when the combination is repeatedly subjected to 60-second application of a voltage of 1 kV with a polarity opposite to the charge of the toner used, followed by 10-second discharging 300 times while measuring the combined volume resistance of the combination, the absolute value of logarithmic difference between the first combined volume resistance and the $300^{th}$ combined volume resistance is not greater than 0.8 [logΩ] is acceptable. Namely, such a combination can be used for the transfer device of the present invention. It is clear from FIG. 1 that when the absolute value of logarithmic difference in combined volume resistance is 0.8 [logΩ], the voltage of the primary transfer bias to be applied to the combination is 6.31 kV, which is lower by about 700 V than the abnormal discharge starting voltage (i.e., 7 kV). Namely, the transfer bias has a relatively large tolerance, and thereby occurrence of the abnormal discharging problem can be prevented even after long repeated use (after production of images of from 200,000 to 300,000).

In the transfer device 29 of the present invention, an image of a negatively-charged toner on the intermediate transfer belt 10 is transferred to a receiving material sheet by the secondary transfer roller 16 which serves as a roller for stretching the intermediate transfer belt and to which a negative secondary bias is applied. The secondary transfer roller 16 is an ion-conducting type transfer roller including an elastic layer containing an ion-conducting agent. As mentioned below, the secondary transfer roller 16 including an elastic layer containing an ion-conducting agent has a property such that change of resistivity with time in a case where a negative secondary bias is applied thereto is smaller than in a case where a positive secondary bias is applied. Therefore, by applying a negative transfer bias to the secondary transfer roller, good image transferring can be maintained for a long period of time. When a positively-charged toner is used, the opposing roller 22 serves as a secondary transfer roller, and a negative transfer bias is applied to the opposing roller 22.

The receiving material sheet passing the secondary transfer nip is charged by the secondary transfer bias. In this case, a jamming problem in that the sheet is electrostatically adhered to the intermediate transfer belt, resulting in mis-feeding (jamming) of the sheet. In addition, a scattering problem in that the toner image on the receiving material is scattered by discharging between the intermediate transfer belt and the receiving material at the exit of the secondary transfer nip may occur. Therefore, it is preferable for the transfer device 29 to include a discharging mechanism for discharging the charges of the receiving material sheet, which is preferably provided at the exit of the secondary transfer nip.

Figure 5:
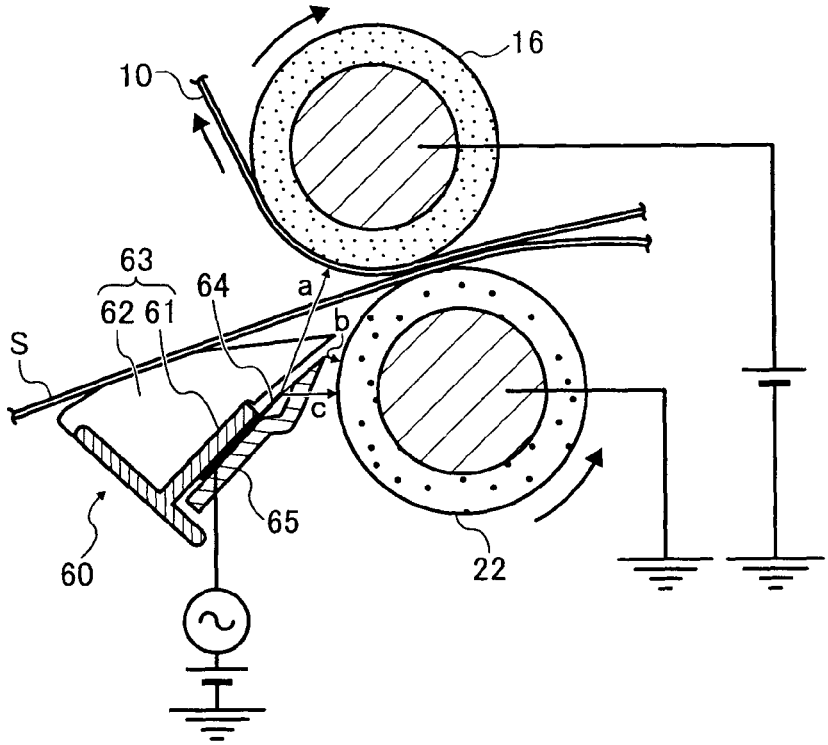
FIG. 5 is an enlarged view illustrating the secondary transfer section of the image forming apparatus illustrated in FIG. 1.

FIG. 5 is an enlarged view of the secondary transfer nip. Referring to FIG. 5, a discharging mechanism 60 for separating a receiving material sheet S from the intermediate transfer belt 10 is provided at a location in the vicinity of the secondary nip and on a downstream side from the secondary nip relative to the feeding direction of the receiving material sheet S. The discharging mechanism 60 includes an exit guide 63 which is an insulating resinous member including a discharge member support 61 and a feeding guide rib 62, which are integrated. The discharging mechanism 60 also includes a discharge member 64, which is supported by the exit guide 63. The discharge member 64 is a thin metal plate having a structure like a comb in which projections like styli are arranged at regular intervals of about few millimeters. The guide rib 62 is located so as not to cover the tips of the projections in order that the guide rib does not interfere discharging between the projections and the receiving material sheet S.

A bias is applied to the discharge member 64 to cause discharging from the tips of the projections, resulting in application of discharge current to the receiving material sheet S. In this regard, a proper bias selected from an AC bias, a DC bias and a combination thereof is applied. Depending on the feeding speed of the receiving material sheet S, the discharge member 64 may be contacted with the sheet S to well perform discharging.

In FIG. 5, character "a" denotes the spatial distance between the discharge point of the discharge member 64 and the intermediate transfer belt 10. In the secondary transfer nip illustrated in FIG. 5, the spatial distance "a" is equal to the distance between the surface of the intermediate transfer belt and the discharge point of the discharge member 64 because there is no material therebetween. Character "b" denotes the spatial distance between the discharge point of the discharge member 64 and the opposing roller 22. In this case, an insulating cover 65 is present between the discharge point of the discharge member 64 and the opposing roller 22. Therefore, the spatial distance is the distance illustrated by the character "b". Character "c" denotes the distance between the discharge point of the discharge member 64 and the opposing roller 22.

In this regard, it is preferable that the separation point, at which the receiving material sheet is separated from the intermediate transfer belt, is not far from the secondary transfer nip so that the receiving material sheet S can be well separated from the intermediate transfer belt 10. Therefore, it is preferable to shorten the distance "c" between the discharge member 64 and the opposing roller 22.

Since a bias having the same polarity as that of charge of the toner is applied to the secondary transfer roller 16 in this example, the receiving material sheet S prevents occurrence of interference between the transfer current and the discharge current. When the discharge current flows in the vicinity of the secondary transfer roller, the discharge current flows into the secondary transfer roller, resulting in deterioration of the image transfer at the secondary transfer nip. In particular, when an AC bias is applied to the discharge member 64, this problem is remarkably caused. Therefore, it is preferable that the distance "a" between the surface of the intermediate transfer belt and the discharge point of the discharge member 64 is long.

In this example, the stretching roller 16 is used as the secondary transfer roller, and therefore the discharge point can be set so as to be far from the secondary transfer roller even when the discharge point is set so as to be close to the exit of the secondary transfer nip. Therefore, occurrence of the current flowing problem mentioned above can be prevented more securely than in a case where the opposing roller is used as the secondary transfer roller. Thus, the discharging mechanism 60 can impart a good combination of receiving material sheet separation property and secondary image transfer property to the transfer device 29.

However, when the electric field strength of the electric field formed between the discharge point and the exit of the secondary transfer nip is not less than 1 kV/mm, an abnormal discharge problem (such as leaking or lighting discharge) occurs. Therefore, the spatial distance has a lower limit. Accordingly, in order to prevent occurrence of such an abnormal discharge problem, the insulating member 65 is provided at a location between the discharge member 64 and the opposing roller 22 so that the spatial distance "b" between the discharge member 64 and the opposing roller 22 is relatively long compared to the distance "c".

When the distance "a" between the discharge point and the intermediate transfer belt 10 is too short and the width of the receiving material sheet S is less than the width of the intermediate transfer belt, discharging occurs between the discharge point and the side portions of the intermediate transfer belt which are not covered with the receiving material sheet. Therefore, an interference problem in that the discharge current and the secondary transfer current interfere, thereby influencing the secondary transfer electric field occurs. Therefore, it is preferable that the spatial distance "a" is longer than the spatial distance "b". In this case, the current of discharging occurring between the discharge point and the opposing roller is greater than that of discharging occurring between the discharge point and the intermediate transfer belt even when the side portions of the intermediate transfer belt are not covered with the receiving material sheet. By decreasing the current of discharging between the discharge point and the intermediate transfer belt, occurrence of the interference problem can be prevented and thereby secondary transferring can be well performed.

In addition, the resistivity of the opposing roller 22 is too low, the discharging current mainly flows into the opposing roller, and thereby the discharging effect of the discharging mechanism deteriorates. Therefore, the volume resistance of the opposing roller 22 is preferably not less than 4 [log Ω] when measured by applying a voltage of 10V thereto.

It is preferable that the secondary transfer bias applied to the secondary transfer roller 16 is subjected to constant-current controlling. This is because the secondary transfer operation is influenced by the size of the receiving material and the resistance thereof, which largely changes depending on the environmental conditions such as humidity. When constant-voltage controlling is performed, the current flowing in the secondary transfer operation largely changes depending on the resistance of the receiving material used. Therefore, it is hard to stably perform good secondary transfer operation. In contrast, when constant-current controlling is performed, the secondary transfer voltage is changed depending on the resistance of the receiving material so that a constant secondary transfer current flows through the secondary transfer nip. Therefore, good secondary transfer operation can be stably performed. However, when the combined volume resistance of the combination of the intermediate transfer belt 10 and the secondary transfer roller 16 largely increases, a problem in that a secondary transfer bias greater than the upper limit of the power source used has to be applied occurs.

In order to prevent occurrence of such a problem, a combination of an intermediate transfer belt and a secondary transfer roller is previously subjected to an evaluation test before being used for the transfer device of the present invention. Specifically, when a combination of an intermediate transfer belt and a secondary transfer roller is subjected to the following evaluation test and the combined volume resistance thereof falls in the predetermined range (i.e., not greater than 0.5 [log Ω]), the combination can be used for the transfer device of the present invention.

The evaluation method is similar to the above-mentioned evaluation method for the combination of the intermediate transfer belt and the primary transfer roller, and the evaluation conditions are as follows.

Instrument used for evaluation: Instrument illustrated in FIG. 4

Applied voltage: −1000V

Charging and discharging: A cycle of charging for 60 seconds, followed by discharging for 10 seconds is repeated 300 times.

The combined volume resistance in each cycle is calculated from the current flowing the combination at a time 10 seconds after the start of charging (voltage application). When the absolute value of the difference (i.e., |log Rv300 (Ω)−log Rv001(Ω)|) between the $300^{th}$ combined volume resistance and the first combined volume resistance is not greater than 0.5 [log Ω], the combination can be used for the transfer device of the present invention.

It is clear from FIG. 1 that when the initial voltage of the secondary transfer bias is 1 kV and the difference in combined volume resistance is not greater than 0.5 [log Ω], the upper limit of voltage of the secondary transfer bias can be controlled so as to be not greater than 4.7 kV, which is lower by 2.3 kV than the abnormal discharging voltage (i.e., 7 kV). Thus, the voltage of the secondary transfer bias has a large tolerance, and therefore good secondary transfer operation can be performed without causing the abnormal discharging problem even when a receiving material having a high resistance is used as the receiving material.

It is preferable that the resistance of the secondary transfer roller 16 is greater than that of the opposing roller 22, preferably by one order or more. In this case, the influence of the opposing roller on the combined volume resistance of the combination of the intermediate transfer belt and the secondary transfer roller can be neglected. Therefore, by merely controlling the change of the combined volume resistance of the combination without considering the opposing roller, the secondary transfer operation can be controlled. Therefore, the evaluation can be easily performed. In addition, by increasing the resistance of the secondary transfer roller, the variation of the combined volume resistance of the combination can be decreased.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

A roller, which has a diameter of 16 mm and in which an ion-conducting foamed material layer made of a NBR having an Asker C hardness of 45 degree is formed on a metal shaft having a diameter of 8 mm, was used as the primary transfer roller.

Figure 6:
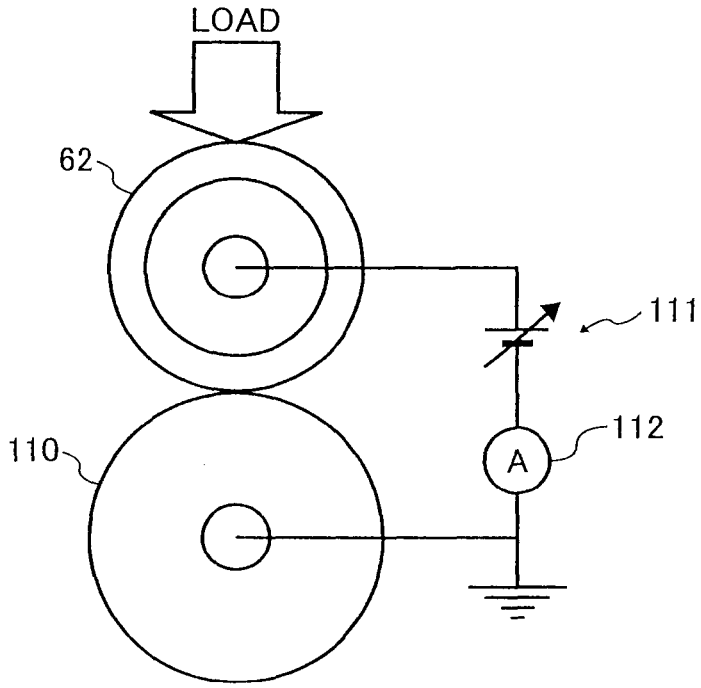
FIG. 6 is a schematic view illustrating an instrument used for measuring the resistivity of a transfer roller.

The resistivity of the primary transfer roller was measured using an instrument illustrated in FIG. 6 in which the primary transfer roller is directly connected with an opposing metal roller 110 without the intermediate transfer belt 10 therebetween. The measuring conditions are as follows.

Applied voltage: +1000V

Charging and discharging: A cycle of charging for 60 seconds, followed by discharging for 10 seconds is repeated 300 times.

Figure 7:
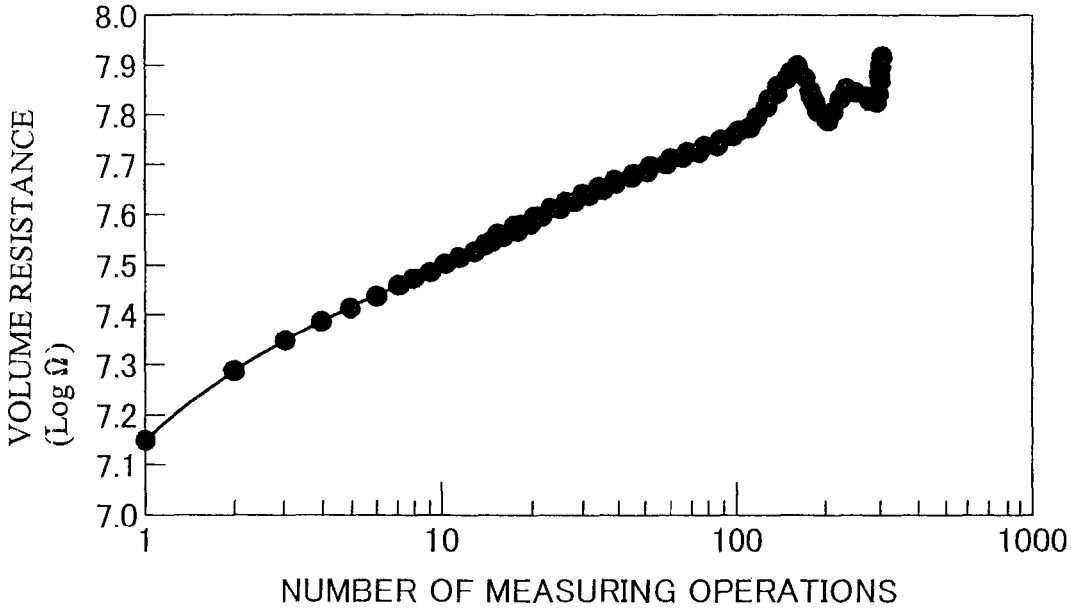
FIG. 7 is a graph illustrating change of the volume resistance of a primary transfer roller.

The combined volume resistance in each cycle is calculated from the current flowing the roller at a time 10 seconds after the start of charging. The results are shown in FIG. 7. It is clear from FIG. 7 that the resistivity of the primary transfer roller increased such that the final resistivity is greater by about 0.75 order than the initial resistivity thereof.

In this example, the intermediate transfer belt is an electroconductive seamless belt which is made by subjecting a combination of a polycarbonate resin (PC) and a polybutylene terephthalate (PBT) to extrusion molding and which has a thickness of 0.15 mm. The volume resistance of the intermediate transfer belt was measured by a method in which a probe is contacted with a surface of the intermediate transfer belt and an electrode which is grounded is contacted with another surface of the intermediate transfer belt. The probe used is a URS probe, which is made of an electroconductive rubber and which is a probe for a high resistance ohm meter, HIGH RESTER UP (MCP-HT450) from Mitsubishi Chemical Corp. The measurement conditions are as follows.

Applied voltage: +200 V

Charging and discharging: A cycle of charging for 60 seconds, followed by discharging for 10 seconds is repeated 300 times.

Figure 8:
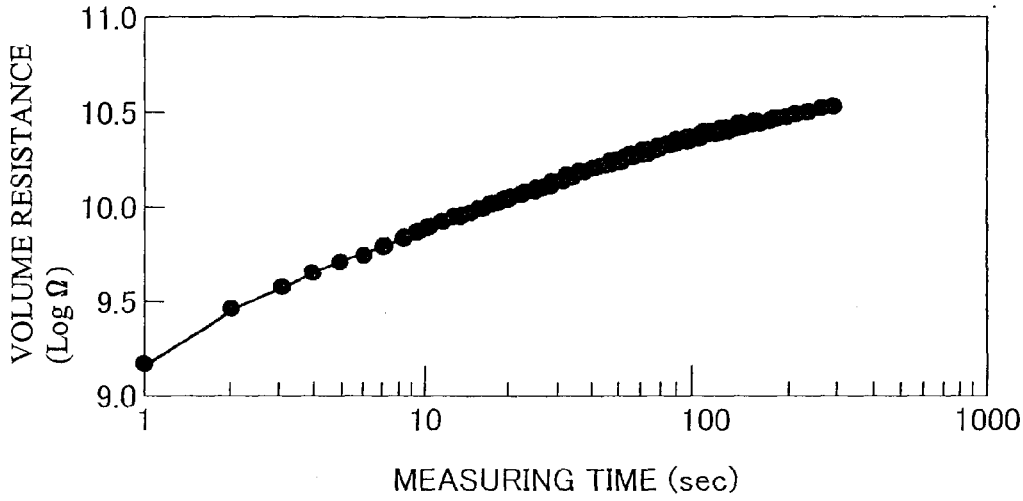
FIG. 8 is a graph illustrating change of the volume resistance of an intermediate transfer medium.

The combined volume resistance in each cycle is calculated from the current flowing the roller at a time 10 seconds after the start of charging. The results are shown in FIG. 8. It is clear from FIG. 8 that the resistivity of the intermediate transfer belt largely increased such that the final resistivity is greater by about 1.5 orders than the initial resistivity thereof.

Next, the combined volume resistance of the above-mentioned primary transfer roller and intermediate transfer belt, which have the resistivity properties illustrated in FIGS. 7 and 8, respectively, was measured using the instrument illustrated in FIG. 4. The measurement conditions are as follows.

Applied voltage: +1000 V

Charging and discharging: A cycle of charging for 60 seconds, followed by discharging for 10 seconds is repeated 300 times.

Figure 9:
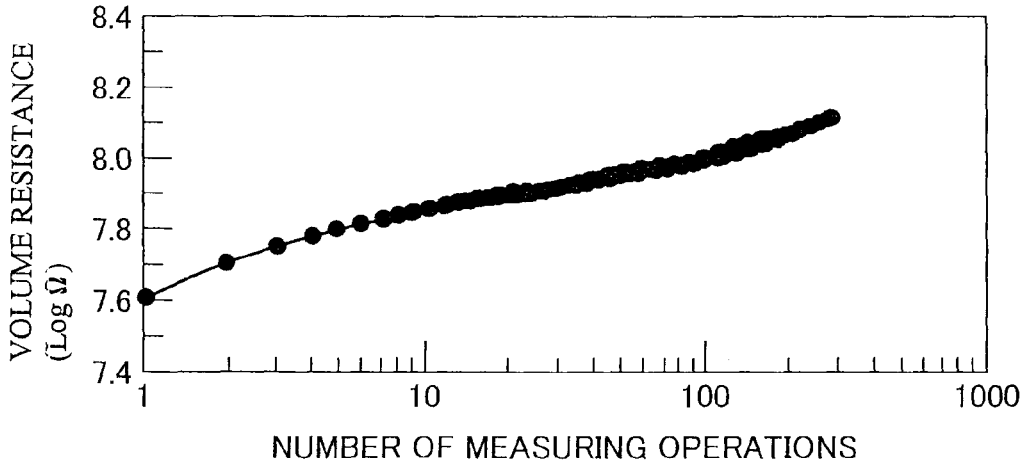
FIG. 9 is a graph illustrating change of the combined volume resistance of a combination of a primary transfer roller and an intermediate transfer medium.

The results are shown in FIG. 9.

It is clear from FIG. 9 that the combined volume resistance increased by about 0.5 order after the 300-time charging and discharging operations. In other words, the change of the combined volume resistance is less than the change of the resistivity of each of the primary transfer roller and the intermediate transfer belt.

The reason therefor is considered to be as follows. The combined volume resistance of a combination of an intermediate transfer belt and a primary transfer roller is influenced by the thickness of the elastic layer of the primary transfer roller and the thickness of the intermediate transfer belt as well as the resistivities of the intermediate transfer belt and primary transfer roller. Therefore, it is considered that in this case the change of the combined volume resistance of the combination becomes smaller than each of the resistivities of the intermediate transfer belt and primary transfer roller due to influence of the factors such as the thickness of the elastic layer of the primary transfer roller and the thickness of the intermediate transfer belt.

Even in a case where the change of the volume resistance of each of an intermediate transfer belt and a primary transfer roller is large, the combination can be used if the change of the combined volume resistance thereof is not greater than 0.8 order (i.e., 0.8 log Ω). Thus, intermediate transfer belts and primary transfer rollers, which do not qualify the conventional evaluation tests, may be used for the transfer device of the present invention. Therefore, loss of parts (i.e., intermediate transfer belts and primary transfer rollers) can be minimized. In addition, as mentioned below, evaluation of intermediate transfer belts and primary transfer rollers can be accurately performed.

Next, the transfer device including the combination mentioned above was installed in an image forming apparatus, which had been prepared by Ricoh Co., Ltd. for evaluation purpose, to perform a running test in which formation of a copy of an image on a receiving paper with A-4 size is repeated 200,000 times while performing constant-current controlling on the primary transfer operation. The combined volume resistance of the combination and the voltage of the primary transfer bias before the running test were 7.5 log Ω and 950V, respectively. After the running test, the combined volume resistance of the combination and the voltage of the primary transfer bias were 7.9 log Ω and 2700 V, respectively.

Thus, the change of the combined volume resistance was 0.4 order, which is almost equal to the change (about 0.5 order) in the above-mentioned evaluation test in which charging of a voltage of +1000 V for 60 seconds followed by discharging for 10 seconds are repeated 300 times. Thus, it was found that the change of the combined volume resistance of the combination in the test in which charging of a voltage of 1 kV with a polarity opposite to that of the charge of the toner for 60 seconds followed by discharging for 10 seconds are repeated 300 times is almost equal to the change of the combined volume resistance thereof in an image forming operation in which 200,000 to 300,000 copies are produced.

In addition, the problems in that abnormal discharging and leaking are caused by the primary transfer bias did not occur during the evaluation test. This is because the change of the combined volume resistance could be controlled so as to be 0.4 order and thereby the maximum voltage of the primary transfer bias could be controlled to be 2700 V, which is much lower than the abnormal discharge voltage (i.e., 7 kV).

Further, the transfer device including the combination mentioned above was installed in the image forming apparatus to perform a running test in which formation of an image on a receiving paper with A-4 size is repeated 200,000 times while performing constant-voltage controlling on the primary transfer operation. In this image forming apparatus, the voltage and current of the primary transfer bias were measured at regular intervals, and a proper voltage is selected from plural preset voltages such that the resultant current is equal to the initial current (i.e., 31 μA).

In this case, the problems in that abnormal discharging and leaking are caused by the primary transfer bias did not occur during the evaluation test.

Example 2

A roller, which has a diameter of 24 mm and in which a layer made of a NBR having a JIS-A hardness of 50 degree is formed on a metal shaft having a diameter of 12 mm, was used as the secondary transfer roller.

The combined volume resistance of the above-mentioned secondary transfer roller and intermediate transfer belt, which have the resistivity properties illustrated in FIGS. 7 and 8, respectively, was measured using the instrument illustrated in FIG. 4. The measurement conditions are as follows.

Applied voltage: +1000 V

Charging and discharging: A cycle of charging for 60 seconds, followed by discharging for 10 seconds is repeated 300 times.

The combined volume resistance in each cycle is calculated from the current flowing the combination at a time 10 seconds after the start of the voltage application operation. The results are shown in FIG. 10.

Next, the above-mentioned combined volume resistance measuring operation was repeated except that the applied voltage was changed to −1000V, the polarity (i.e., negative) of which is the same as that of charge of the toner used. The results are shown in FIG. 11.

Figure 10:
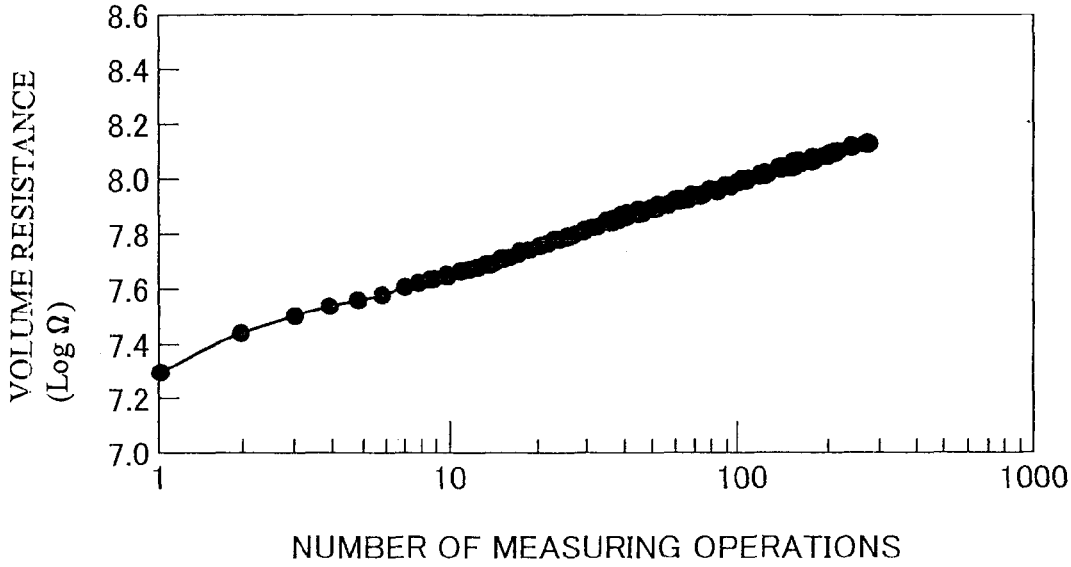
FIG. 10 is a graph illustrating change of the combined volume resistance of a combination of a secondary transfer roller and an intermediate transfer medium when +1000V is applied thereto.
Figure 11:
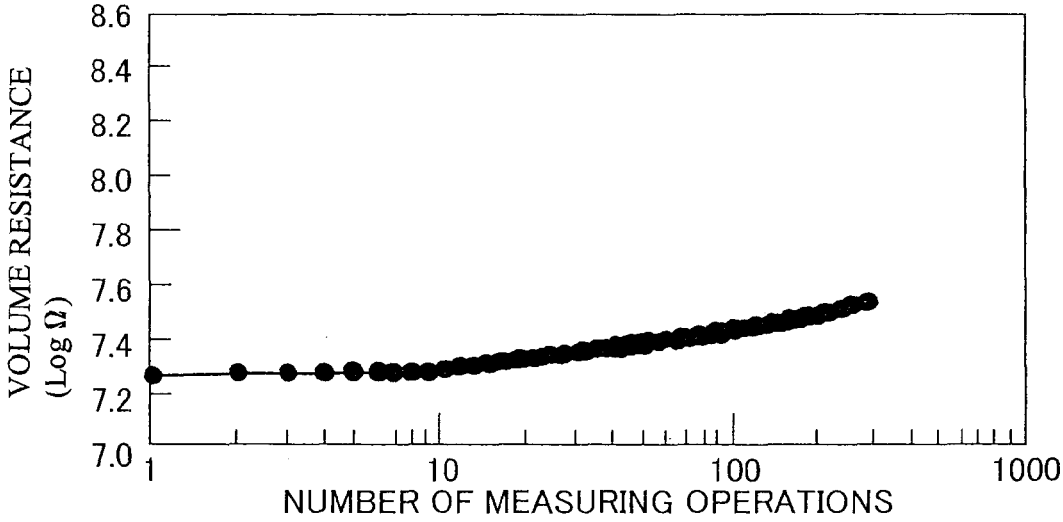
FIG. 11 is a graph illustrating change of the combined volume resistance of a combination of a secondary transfer roller and an intermediate transfer medium when −1000V is applied thereto.

It is clear from FIGS. 10 and 11 that when +1000V was applied, the combined volume resistance increased by about 0.9 order whereas the combined volume resistance increased by about 0.3 order when −1000V was applied. Namely, the change of the combined volume resistance in the case of applying −1000V is less than that in the case of applying +1000V. It is clear from FIG. 1 that when the combined volume resistance increases by 0.9 order, the voltage of the transfer bias has to be increased 7.94 times. Since the voltage of the initial secondary transfer bias is 1.5 kV, the voltage has to be increased to 11.9 kV (1.5×7.94) after production of 200,000 to 300,000 images. Since this voltage is much greater than the discharge voltage (7.0 kV), the discharge problem will occur.

In contrast, when a negative voltage is applied, the change of the combined volume resistance is about 0.3 order. In this case, the voltage of the secondary transfer bias has to be increased twice. Specifically, the voltage of the secondary transfer bias is 3 kV (1.5×2) after production of 200,000 to 300,000 images, which is much less than the discharge voltage (7.0 kV). Therefore, even when a receiving material having a high resistance is used, occurrence of the discharge problem can be prevented.

Example 3

A roller, which has a diameter of 18 mm and in which an ion-conducting foamed material layer made of a NBR having an Asker C hardness of 45 degree is formed on a metal shaft having a diameter of 10 mm, was used as the opposing roller 22. The volume resistance of the roller was 5.0 log Ω when measured by applying a voltage of 50 V to the roller.

A roller, which has a diameter of 24 mm and in which a layer made of a NBR having a JIS-A hardness of 50 degree is formed on a metal shaft having a diameter of 12 mm, was used as the secondary transfer roller. The volume resistance of the roller was 7.15 log Ω when measured by applying a voltage of 1 kV to the roller. Although the applied voltage is different, the volume resistivities of the rollers are different from the other by not less than two orders.

The reason why the volume resistivities of the rollers cannot be measured by the same applied voltage is that if the volume resistance of the opposing roller is measured by applying a voltage of 1000 V, a current greater than the upper limit of the power source used for the measurement instrument flows, and thereby the applied voltage cannot be maintained. In this case, it becomes impossible to measure the volume resistance. Accordingly, a voltage of 50 V is applied to measure the volume resistance of the opposing roller.

The transfer device of Example 3 has a configuration as illustrated in FIG. 5. Namely, the discharging mechanism 60 configured to separate a sheet of the receiving material bearing a toner image from the intermediate transfer belt 10 is provided on a downstream side from the secondary nip relative to the feeding direction of the receiving material. The discharging member 64 includes projections (styli), which are arranged at intervals of 1 mm and to which an AC voltage having a peak-to-peak voltage of 8 kV is applied.

At first, an image transfer operation was performed while applying a secondary transfer bias to the opposing roller. As a result, the transfer ability of the transfer device deteriorated. The reason therefor is considered as follows. The discharge current flowing into the opposing roller from the discharge projections (styli), resulting in occurrence of interference between the discharge current and the secondary transfer current, thereby decreasing the secondary transfer current. Therefore, the transferability deteriorated.

Next, an image transfer operation was performed while applying a secondary transfer bias to the secondary transfer roller (i.e., a roller stretching the intermediate transfer belt) As a result, the toner image could be well transferred. The reason therefor is considered as follows. Since the distance between the secondary transfer roller and the discharging mechanism is longer than that between the opposing roller and the discharge mechanism, the interference between the discharge current and the secondary transfer current is smaller than that in the case where the secondary transfer bias is applied to the opposing roller. Therefore the toner image sheet could be well transferred. In addition, since charges of the receiving material could be well discharged, problems in that the toner image scatters and the receiving material sheet jams at the exit of the secondary transfer nip were not caused.

As mentioned above, the transfer device of the present invention includes a combination of an intermediate transfer medium (such as intermediate transfer belts) and a primary transfer member (such as transfer rollers), which has a property such that when the combination is repeatedly subjected to charging and discharging, in which a voltage of 1 kV with a polarity opposite to the charge of the toner used is applied for 60 seconds, and then discharging is performed for 10 seconds, 300 times while measuring the combined volume resistance of the combination, the absolute value of logarithmic difference between the first combined volume resistance and the $300^{th}$ combined volume resistance is not greater than 0.8 [log Ω]. When such a combination is used, it is not necessary to increase the voltage of the primary transfer bias to the discharge voltage (7 kV) even after long repeated use (production of 200,000 to 300,000 images), and thereby occurrence of the abnormal discharging problem can be prevented. The cost of this evaluation method is relatively low compared to that of a conventional evaluation method in which change in resistivity of each of the intermediate transfer medium and the primary transfer member is evaluated. Namely, only one evaluation operation is performed in the present evaluation method whereas two evaluation operations are performed in the conventional evaluation method, and therefore the evaluation costs can be reduced. In addition, such a conventional evaluation method has a drawback in that the change in resistivity of each of the intermediate transfer medium and the primary transfer member has to be controlled so as to fall within a relatively narrow range. This is because even when each of the intermediate transfer medium and the primary transfer, there is a case where the combination cannot be used. Therefore, the volume resistance range of each member has to be narrowed. Therefore, the percentage of the defective intermediate transfer medium and primary transfer member increases, which cannot be used for the transfer device, resulting in increase of the costs of the transfer device. Further, as mentioned above in Example 1, there is a case where even when the change of volume resistance of one (or both) of the intermediate transfer medium and primary transfer member is large so as not to be used, the combination can be used for the transfer device of the present invention. Therefore, the percentage of the defective intermediate transfer medium and primary transfer member can be decreased in the present invention, resulting in decrease of the costs of the transfer device.

In addition, a member (such as rollers) including an ion-conducting material is used for the primary transfer member, and therefore the member has little unevenness in resistivity. Therefore, uneven transfer of toner images can be avoided.

Further, the primary transfer bias is subjected to constant-current controlling. Therefore, even when the combined volume resistance of the combination increases, the predetermined primary transfer current flows through the primary transfer nip, resulting in prevention of deterioration of the transferability. Since the change of the combined volume resistance of the combination is not greater than 0.8 [log Ω], the voltage of the primary transfer bias is not increased to the discharge voltage (7 kV) even when constant-current controlling is performed on the primary transfer bias, and thereby occurrence of the abnormal discharge problem can be prevented.

When the primary transfer bias is subjected to constant-voltage controlling, the voltage of the primary transfer bias is maintained to be constant even when the current flowing the toner image at the primary transfer nip changes due to the area of the toner image. Therefore, deterioration of transferability of the transfer device can be prevented. In this case, when the combined volume resistance increases, the transferability deteriorates. However, in the present invention the voltage and current of the primary transfer bias are checked at predetermined intervals, and the voltage of the primary transfer bias is changed such that the predetermined primary transfer current flows. Even when constant-voltage controlling is performed on the primary transfer bias, the voltage of the primary transfer bias is not increased to the discharge voltage (7 kV), and thereby occurrence of the abnormal discharge problem can be prevented.

Further, the transfer device can include a combination of an intermediate transfer medium and a secondary transfer member, which contacts the backside of the intermediate transfer medium and to which a negative secondary bias is applied. The combination has a property such that when the combination is repeatedly subjected to charging and discharging, in which a voltage of −1 kV is applied to the charge of the toner for 60 seconds and then discharging is performed for 10 seconds, 300 times while measuring the combined volume resistance of the combination, the absolute value of logarithmic difference between the first combined volume resistance and the $300^{th}$ combined volume resistance is not greater than 0.5 [log(Ω)]. When such a combination is used, it is not necessary to increase the voltage of the secondary transfer bias to the discharge voltage (7 kV) even after long repeated use (production of 200,000 to 300,000 images), and thereby occurrence of the abnormal discharging problem can be prevented. The cost of this evaluation method is relatively low compared to that of a conventional evaluation method in which change in resistivity of each of the intermediate transfer medium and the secondary transfer member is evaluated. Namely, only one evaluation operation is performed in the present evaluation method whereas two evaluation operations are performed in the conventional evaluation method, and therefore the evaluation costs can be reduced.

In addition, such a conventional evaluation method has a drawback in that change in resistivity of each of the intermediate transfer medium and the secondary transfer member has to be controlled so as to fall within a relatively narrow range for the reason mentioned above. Therefore, the percentage of the defective intermediate transfer medium and secondary transfer member increases, which cannot be used for the transfer device, resulting in increase of the costs of the transfer device.

In the present invention, even when the change of volume resistance of one (or both) of the intermediate transfer medium and secondary transfer member is large so as not to be used, the combination can be used for the transfer device of the present invention if the change of the combined volume resistance of the combination falls in the above-mentioned range. Therefore, the percentage of the defective intermediate transfer medium and secondary transfer member can be decreased, resulting in decrease of the costs of the conventional transfer device of the present invention.

In addition, since a negative secondary transfer bias is applied, the change of the combined volume resistance can be relatively decreased compared to that in a case where a positive secondary transfer bias is applied. Therefore, occurrence of the abnormal discharge problem can be prevented.

Further, the resistance of the secondary transfer member is controlled so as to be relatively high compared to that of the opposing roller, which sandwiches the intermediate transfer member together with the secondary transfer member. By increasing the resistance of the secondary transfer member, the initial combined volume resistance of the combination of the intermediate transfer medium and the secondary transfer member can be increased. Therefore, change of the combined volume resistance of the combination can be suppressed. Specifically, when the initial combined volume resistance is 100 Ω and the resistivity increases to 1000 Ω (i.e., the difference is 900Ω) after repeated use, the resistivity changes by one order. In contrast, in a case where the initial combined volume resistance is 1000 Ω, the resistivity changes by one order if the resistivity increases to 10000 Ω (i.e., the difference is 9000Ω). Thus, when the initial combined volume resistance is relatively high, the change of the combined volume resistance can be controlled so as to be small.

Furthermore, the resistance of the secondary transfer member is controlled so as to be higher by one order or more than that of the opposing member. Therefore, the influence of the opposing member on the secondary image transfer can be minimized. In other words, it is not necessary to watch the change of the resistance of the opposing roller, resulting in reduction of the management costs.

In addition, in the present invention a member (such as rollers) including an ion-conducting material is used for the secondary transfer member, and therefore the member has little unevenness in resistivity. Therefore, uneven transfer of toner images can be avoided. In addition, the member has a property such that when a negative bias is applied, the degree of deterioration of the member after repeated use is less than that in the case where a positive bias is applied. Therefore, by applying a negative secondary transfer bias to the secondary transfer member, change of the combined volume resistance of the combination can be decreased, and thereby occurrence of the abnormal discharging problem can be prevented.

In addition, a discharging mechanism is provided at a location just after the secondary transfer nip. Therefore, a jamming problem in that the receiving material is electrostatically wound around the intermediate transfer medium, resulting jamming of the receiving material, and a toner scattering problem in that toner particles constituting a solid toner image are scattered due to discharging between the intermediate transfer medium and the receiving material at the exit of the secondary transfer nip, can be avoided.

Further, one of the rollers stretching the intermediate transfer medium is used as the secondary transfer member, the distance between the secondary transfer member and the discharge mechanism is longer than that in the case where the opposing roller is used as the secondary transfer member. Therefore, the problem in that discharge current flows into the secondary transfer member, resulting in deterioration of the transferability can be avoided.

The electric property of a combination of an intermediate transfer medium and a transfer member (such as primary and secondary transfer members) can be easily evaluated by the evaluation method of the present invention. The method includes the following steps:

sandwiching the intermediate transfer medium by the transfer member and a metal electrode;

repeatedly subjecting the combination to an ON-OFF operation (for example, 60-second charging followed by 10-second discharging) of a voltage which is equal to the initial voltage of a transfer bias applied to the transfer member predetermined times (300 times) while measuring the combined volume resistance of the combination; and calculating change of the combined volume resistance of the combination to determine whether the change falls in the predetermined range.

By using this evaluation method, a combination of an intermediate transfer medium and a transfer member can be easily and accurately evaluated.

This document claims priority and contains subject matter related to Japanese Patent Application No. 2006-157510, filed on Jun. 06, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method for evaluating an electric property of a combination of an intermediate transfer medium bearing a material thereon, and a transfer member configured to transfer a material onto the intermediate transfer medium or transfer a material on the intermediate transfer medium to another material while contacting a backside of the intermediate transfer medium and applying a transfer bias thereto, comprising:

sandwiching the intermediate transfer medium by the transfer member and a metal electrode;

repeatedly subjecting the combination to an ON-OFF operation of a voltage, which is equal to an initial voltage of the transfer bias and which is applied between the transfer member and the metal electrode, predetermined times while measuring a combined volume resistance of the combination; and calculating change of the combined volume resistance of the combination to determine whether the change falls in a predetermined range.

2. A transfer device comprising:

an intermediate transfer medium which rotates while contacting an image bearing member; and a first transfer member which transfers a toner image on the image bearing member to a side of the intermediate transfer medium at a first transfer nip while contacting a backside of the intermediate transfer medium and applying a first transfer bias thereto, wherein a first combination of the intermediate transfer medium and the first transfer member has a property such that when the first combination is repeatedly subjected to charging and discharging, in which a voltage of 1 kV with a polarity opposite to a charge of the toner is applied for 60 seconds, and then discharging is performed for 10 seconds, 300 times while measuring a combined volume resistance of the first combination, an absolute value of logarithmic difference between a first combined volume resistance and a $300^{th}$ combined volume resistance is not greater than 0.8 [log(Ω)].

3. The transfer device according to claim 2, wherein the first transfer member includes a portion, which includes an ion-conducting material and which contacts the intermediate transfer medium.

4. The transfer device according to claim 2, wherein the first transfer bias is subjected to constant-current controlling.

5. The transfer device according to claim 2, wherein the first transfer bias is subjected to constant-voltage controlling.

6. The transfer device according to claim 2, further comprising:

a second transfer member configured to transfer the toner image on the intermediate transfer medium to a receiving material at a second transfer nip while contacting a backside of the intermediate transfer medium and applying a negative second transfer bias thereto; and an opposing member which contacts a backside of the receiving material to transfer the toner image on the intermediate transfer medium to the receiving material at the second transfer nip together with the second transfer member, wherein a second combination of the intermediate transfer medium and the second transfer member has a property such that when the second combination is repeatedly subjected to charging and discharging, in which a voltage of −1 kV is applied for 60 seconds, and then discharging is performed for 10 seconds, 300 times while measuring a combined volume resistance of the second combination, an absolute value of logarithmic difference between a first combined volume resistance and a $300^{th}$ combined volume resistance is not greater than 0.5 [log(Ω)].

7. An image forming apparatus comprising:

an image bearing member configured to bear a toner image thereon; and a transfer device configured to transfer the toner image borne by the image bearing member to a receiving material via an intermediate transfer medium, wherein the transfer device is the transfer device according to claim 6.

8. An image forming apparatus comprising:

an image bearing member configured to bear a toner image thereon; and a transfer device configured to transfer the toner image on the image bearing member to an intermediate transfer medium, wherein the transfer device is the transfer device according to claim 2.

9. A transfer device comprising:

an intermediate transfer medium which rotates while bearing a toner image thereon;

a transfer member configured to transfer the toner image on the intermediate transfer medium to a receiving material at a transfer nip while contacting a backside of the intermediate transfer medium and applying a negative transfer bias thereto; and an opposing member which contacts a backside of the receiving material to transfer the toner image on the intermediate transfer medium to the receiving material at the transfer nip together with the transfer member, wherein a combination of the intermediate transfer medium and the transfer member has a property such that when the combination is repeatedly subjected to charging and discharging, in which a voltage of −1 kV is applied for 60 seconds, and then discharging is performed for 10 seconds, 300 times while measuring a combined volume resistance of the combination, an absolute value of logarithmic difference between a first combined volume resistance and a $300^{th}$ combined volume resistance is not greater than 0.5 [log(Ω)].

10. The transfer device according to claim 9, wherein the transfer member has a resistance greater than a resistance of the opposing member.

11. The transfer device according to claim 10, wherein the transfer member has a resistance greater by at least one order than a resistance of the opposing member.

12. The transfer device according to claim 9, wherein the transfer device further comprises:

a discharging mechanism configured to discharge a charge of the receiving material after the receiving material passes the transfer nip.

13. The transfer device according to claim 9, wherein the transfer member includes a portion, which includes an ion-conducting material and which contacts the intermediate transfer medium.

14. The transfer device according to claim 9, wherein the transfer bias is subjected to constant-current controlling.

15. An image forming apparatus comprising:

an image bearing member configured to bear a toner image thereon; and a transfer device configured to transfer the toner image borne by the image bearing member to a receiving material via an intermediate transfer medium, wherein the transfer device is the transfer device according to claim 9.

16. A method of producing a transfer device of good quality, which includes an intermediate transfer medium and at least one transfer member for applying a transfer bias to the intermediate transfer medium, comprising:

a) providing a candidate combination of a candidate for the intermediate transfer medium and a candidate for the transfer member;

b) repeatedly subjecting the candidate combination to a voltage ON-OFF operation, in which a voltage equal to the transfer bias is applied to the combination, predetermined times while measuring a combined volume resistance of the combination;

c) calculating change of the combined volume resistance of the candidate combination to determine whether the change falls in a predetermined range;

if the change falls in the predetermined range, the candidate combination is determined to be an acceptable combination;

if the change does not fall in the predetermined range, providing at least one further candidate combination, and repeating the steps b) and c) for the at least one further candidate combination until an acceptable combination has been determined; and assembling the transfer device using the acceptable combination.

17. The method according to claim 16, wherein the at least one transfer member comprises:

a first transfer member configured to transfer a toner image on the image on an image bearing member to a front side of the intermediate transfer at a first transfer nip while contacting a backside of the intermediate transfer medium and applying a first transfer bias thereto, wherein the step b) comprises:

repeatedly subjecting a first candidate combination of a candidate for the intermediate transfer medium and a candidate for the first transfer member to a voltage ON-OFF operation, in which a voltage of 1 kV with a polarity opposite to a charge of the toner is applied to the combination, 300 times while measuring a combined volume resistance of the first candidate combination, and wherein the step c) comprises:

calculating change of the combined volume resistance of the first candidate combination to determine that the change falls within the predetermined range if an absolute value of logarithmic difference between a first combined volume resistance of the first candidate combination and a $300^{th}$ combined volume resistance thereof is not greater than 0.8 [log(Ω)].

18. The method according to claim 17, wherein the at least one transfer member comprises:

a second transfer member configured to transfer the toner image on the intermediate transfer medium to a receiving material at a second transfer nip while contacting the backside of the intermediate transfer medium and applying a negative second transfer bias thereto; and an opposing member which contacts a backside of the receiving material to transfer the toner image on the intermediate transfer medium to the receiving material at the second transfer nip together with the second transfer member, wherein the step b) comprises:

repeatedly subjecting a second candidate combination of a candidate for the intermediate transfer medium and a candidate for the second transfer member to a voltage ON-OFF operation, in which a voltage of −1 kV is applied to the combination, 300 times while measuring a combined volume resistance of the second candidate combination, and wherein the step c) comprises:

calculating change of the combined volume resistance of the second candidate combination to determine that the change falls within the predetermined range if an absolute value of logarithmic difference between a first combined volume resistance of the second candidate combination and a $300^{th}$ combined volume resistance thereof is not greater than 0.5 [log(Ω)].

* * * * *